US010926300B2

(12) United States Patent
McCracken

(10) Patent No.: US 10,926,300 B2
(45) Date of Patent: Feb. 23, 2021

(54) WATERCRAFT CLEANING SYSTEMS AND METHODS

(71) Applicant: Harvey William McCracken, Liverpool, TX (US)

(72) Inventor: Harvey William McCracken, Liverpool, TX (US)

( * ) Notice: Subject to any disclaimer, the term of this patent is extended or adjusted under 35 U.S.C. 154(b) by 168 days.

(21) Appl. No.: 16/156,236

(22) Filed: Oct. 10, 2018

(65) Prior Publication Data

US 2019/0201940 A1 Jul. 4, 2019

Related U.S. Application Data

(60) Provisional application No. 62/611,203, filed on Dec. 28, 2017.

(51) Int. Cl.

| | |
|---|---|
| ***B08B 3/02*** | (2006.01) |
| ***B63B 59/06*** | (2006.01) |
| ***B08B 3/10*** | (2006.01) |
| *F04B 17/03* | (2006.01) |

(52) U.S. Cl.

CPC ..... *B08B 3/026* (2013.01); *B08B 3/10* (2013.01); *B63B 59/06* (2013.01); *B08B 2203/007* (2013.01); *B08B 2203/0211* (2013.01); *B08B 2203/0217* (2013.01); *B08B 2203/0223* (2013.01); *B08B 2203/0282* (2013.01); *F04B 17/03* (2013.01)

(58) Field of Classification Search

None

See application file for complete search history.

(56) References Cited

U.S. PATENT DOCUMENTS

| | | | | |
|---|---|---|---|---|
| 4,967,960 | A * | 11/1990 | Futrell | B08B 3/026 239/148 |
| 5,378,119 | A * | 1/1995 | Goertzen | F04B 35/04 312/236 |
| 6,044,852 | A * | 4/2000 | Epperson, Jr. | B08B 3/006 134/108 |
| 2005/0183231 | A1* | 8/2005 | Mein | A47L 9/0009 15/321 |
| 2016/0184846 | A1* | 6/2016 | Pellin | B29B 7/7404 239/135 |

* cited by examiner

*Primary Examiner* — Levon J Shahinian
*Assistant Examiner* — Jason P Riggleman

(57) ABSTRACT

The disclosure includes a watercraft cleaning system that includes a housing, a water input line, a pump and motor system, a high-pressure output line, and a heater. The cleaning system can be arranged and configured to be coupled to a dock post located adjacent a watercraft. The system can easily and conveniently allow watercraft personnel to clean the watercraft.

17 Claims, 6 Drawing Sheets

WATERCRAFT CLEANING SYSTEMS AND METHODS

CROSS-REFERENCE TO RELATED APPLICATIONS

This application claims the benefit of and is a non-provisional of U.S. Patent Application No. 62/611,203; filed Dec. 28, 2017; and entitled WATERCRAFT CLEANING SYSTEMS AND METHODS. The entire contents of U.S. Patent Application No. 62/611,203 are incorporated herein by reference.

BACKGROUND

Field

Various embodiments disclosed herein relate to cleaning systems and methods. Certain embodiments relate to cleaning systems and methods for watercraft.

Description of Related Art

During use, watercraft equipment, such as boats, can become coated with barnacles, algae, salt, and other organisms. Consequently, dirty watercraft may become unsightly and produce unpleasant odors. Additionally, the dirt buildup can cause the watercraft to suffer decreased speed, increased fuel consumption, and even corrosion.

Unfortunately, currently available cleaning systems can be difficult to setup and cumbersome to position next to watercraft. Thus, there is a need for cleaning systems and methods that are easier to setup and able to be positioned adjacent to watercraft with minimal effort.

SUMMARY

The disclosure includes a watercraft cleaning system, including a housing arranged and configured to be coupled to a dock post located adjacent a watercraft. The system can include a water input line mechanically coupled to the housing. The system can also include a pump and motor system mechanically coupled to an internal portion of the housing and operatively coupled to the water line input. The pump and motor system can be arranged and configured to increase water pressure from the water line input. Systems may also include a high-pressure output line mechanically coupled to the housing and fluidly coupled to the water line input. Systems may even include a heater mechanically coupled to an internal portion of the housing. The heater may be arranged and configured to heat an internal portion of the housing.

The system may include an electrical power supply electrically coupled to the pump and motor system. In some embodiments, electrical power from the electrical power supply is transmitted to the pump and motor system via a ground fault circuit interrupter plug mechanically coupled to the housing.

Embodiments may also include a power button mechanically coupled to the housing and electrically coupled to the pump and motor system. The power button may be arranged and configured to power on the cleaning system.

In some embodiments, the system includes a soap and wax input fluidly coupled to the water line. The system may also include a soap and wax power switch mechanically coupled to the housing and operatively coupled to the soap and wax input to thereby allow a user to include and exclude soap and wax.

Systems may also include a soap and wax indication light mechanically coupled to the housing and electrically coupled to the soap and wax power switch to thereby provide an indication as to whether soap and wax is being outputted. A front portion of the housing may comprise a cover that hingedly moves with respect to the housing thereby allowing a user to access the internal portion of the housing. The system may also include a handle and key system mechanically and operatively coupled to the cover whereby the handle and key system allows the user to hingedly move the cover with respect to the housing. The power button, the soap and wax power switch, and the soap and wax indication light may be located on the cover. The power button, the soap and wax power switch, and the soap and wax indication light may be located closer to a top edge of the housing than a bottom edge of the housing and located along a same side of the locking latch.

The system may also include a first vent coupled to the housing and located along a first side of the housing. The first vent may be located closer to a bottom edge of the housing than a top edge of the housing. The system may even include a second vent coupled to the housing and located along a second side of the housing, the second side located opposite the first side. The second vent may be located closer to the top edge of the housing than the bottom edge of the housing.

In some embodiments, the system includes a soap and wax solenoid valve coupled to the internal portion of the housing. The soap and wax solenoid valve may be arranged and configured to control whether soap and wax is outputted. Furthermore, the soap and wax solenoid valve may be located adjacent to the pump and motor system.

In some embodiments, the system includes a motor contactor electrically coupled to the electrical power supply and electrically coupled to the pump and motor system. The motor contactor may be arranged and configured to control electrical power to the pump and motor system. The motor contactor may be further arranged and configured to protect the pump and motor system from electrical overloads. In some embodiments, the housing is constructed of stainless steel. In some embodiments, the housing is constructed of aluminum.

In many embodiments, the system includes a thermostat operatively coupled to the heater. The thermostat may be arranged and configured to activate the heater when a temperature within the internal portion of the housing reaches a predetermined temperature. The system may be arranged and configured such that when the pump and motor system is activated, the heater is deactivated.

Even still, in some embodiments, the housing comprises a removable back cover arranged and configured to expose the internal portion of the housing. The removable back cover may make it easier for a user to access the components located along the internal portion of the housing.

BRIEF DESCRIPTION OF THE DRAWINGS

These and other features, aspects, and advantages are described below with reference to the drawings, which are intended to illustrate, but not to limit, the invention. In the drawings, like reference characters denote corresponding features consistently throughout similar embodiments.

DETAILED DESCRIPTION

Figure 1:
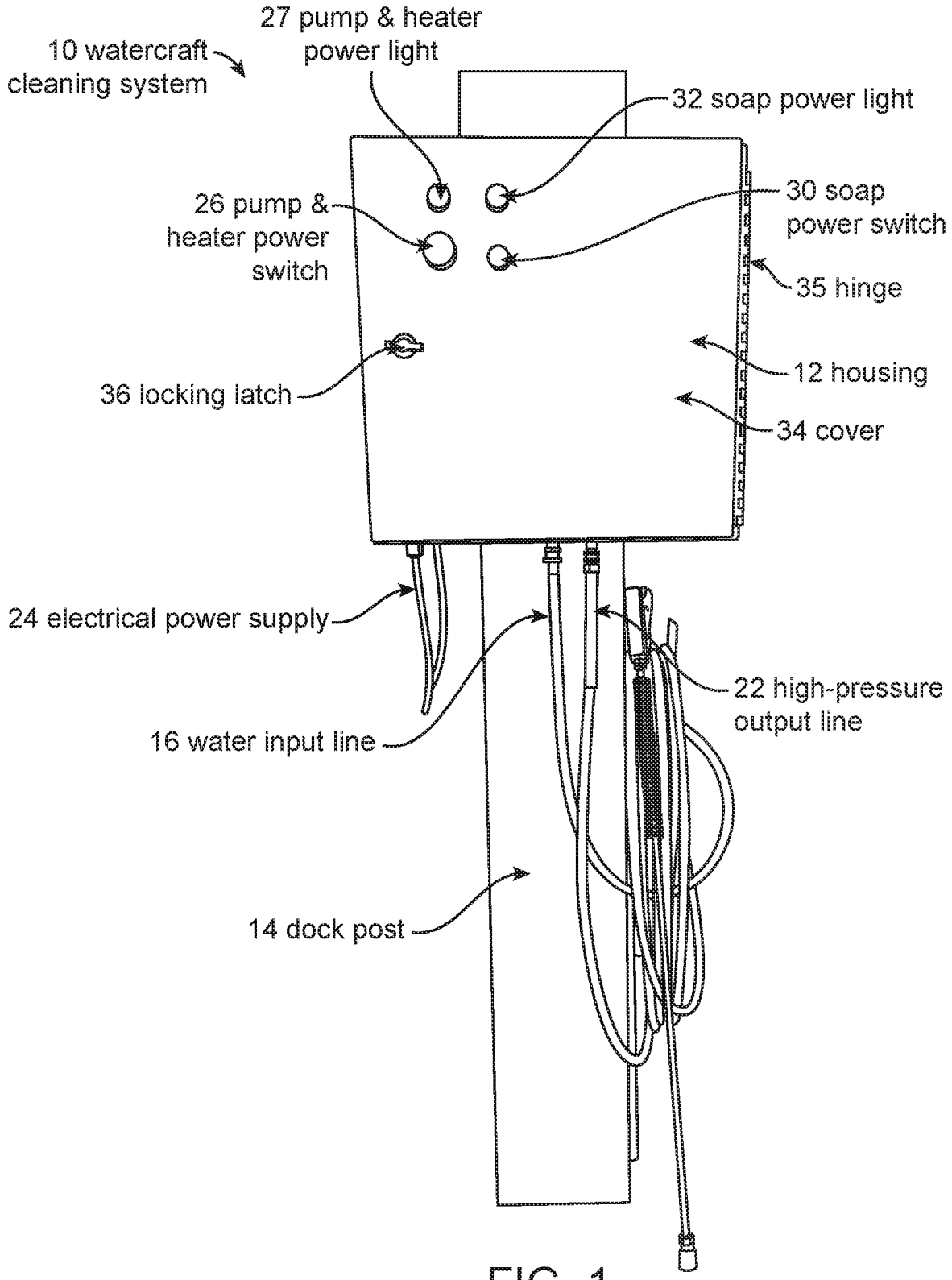
FIG. 1 illustrates a front view of a watercraft cleaning system, according to some embodiments.

Although certain embodiments and examples are disclosed below, inventive subject matter extends beyond the specifically disclosed embodiments to other alternative embodiments and/or uses, and to modifications and equivalents thereof. Thus, the scope of the claims appended hereto is not limited by any of the particular embodiments described below. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components.

For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

LIST OF REFERENCE NUMERALS

10—Watercraft cleaning system
12—Housing
14—Dock post
16—Water line input
18—Pump and motor system
18*a*—Motor
18*b*—Pump
20—Internal portion of housing
22—High-pressure output line
24—Electrical power supply
26—Power button
27—Pump and heater power light
28—Soap and wax input
30—Soap and wax power switch
32—Soap and wax indication light
33—Soap reservoir
34—Cover
35—Hinge
36—Locking latch
37—Control wires
38—Vent
39—Heater
40*a*—First side
40*b*—Second side
42*a*—Bottom edge
42*b*—Top edge
44—Soap and wax solenoid valve
46—Soap injector
48—Motor contactor
50—Thermostat
51—Heater fuse holder
52—Jumpers
53—Contactor fuse holder
54—Control circuit breaker
56—Ground terminal strip
58—Removable back cover As shown in FIG. 1, the disclosure includes a watercraft cleaning system 10. The system 10 can include a housing 12 arranged and configured to be coupled to a dock post 14 located adjacent a watercraft, such as a boat. In this regard, the watercraft cleaning system 10 may remedy the deficiencies as described above.

The system 10, including the housing 12, may be constructed of materials that are safe to use in a marine environment. For example, the housing 12 may be constructed of stainless steel, aluminum, and the like. In many embodiments, the housing completely encloses the internal portion of the housing and/or all of the components used in the system.

Additionally, the system 10 may include a water input line 16 mechanically coupled to the housing 12 and a pump and motor system 18 mechanically coupled to an internal portion of the housing 20 and operatively coupled to the water line input 16. The pump and motor system 18 may be arranged and configured to increase pressure of water from the water line input 16. Systems 10 may also include a high-pressure output line 22 mechanically coupled to the housing 12 and fluidly coupled to the water line input 16. The high-pressure output line 22 may dispense various liquids and substances, such as water, wax, and soap, at high-pressures so that the user may thereby clean the watercraft.

In many embodiments, the system 10 includes an electrical power supply 24 electrically coupled to the pump and motor system 18 to power the system 10. Electrical power from the electrical power supply 24 may be transmitted to the pump and motor system 18 via a ground fault circuit interrupter (GFCI) plug mechanically coupled to the housing 12. It should be appreciated that the GFCI may shut off electric power when the GFCI detects that current is flowing along an unintended path, such as through water or a person.

The system 10 may include a power button 26 mechanically coupled to the housing 12 and electrically coupled to the pump and motor system 18. The power button 26 may be arranged and configured to power on the cleaning system 10 when it is pulled, pressed, and the like. In some embodiments, as shown in FIG. 1, the power button 26 is arranged and configured to control the power of at least one of the pump and motor system 18, motor 18*a*, pump 18*b*, and the heater 39. However, the power button 26 may be arranged and configured to control power of any component listed in this disclosure. It should be appreciated that the power button 26 may be electrically and communicatively coupled to the various components via control wires 37. In some embodiments, the power button 26 sends power to a motor contactor 48, which will be described later, when pulled out. The power button 26 may also cause a pump and heater power light 27 to illuminate, and prevent power from being directed to the thermostat 50 and/or heater 39. It should be appreciated that the opposite occurs when the power button 26 is pushed back in.

Figure 4:
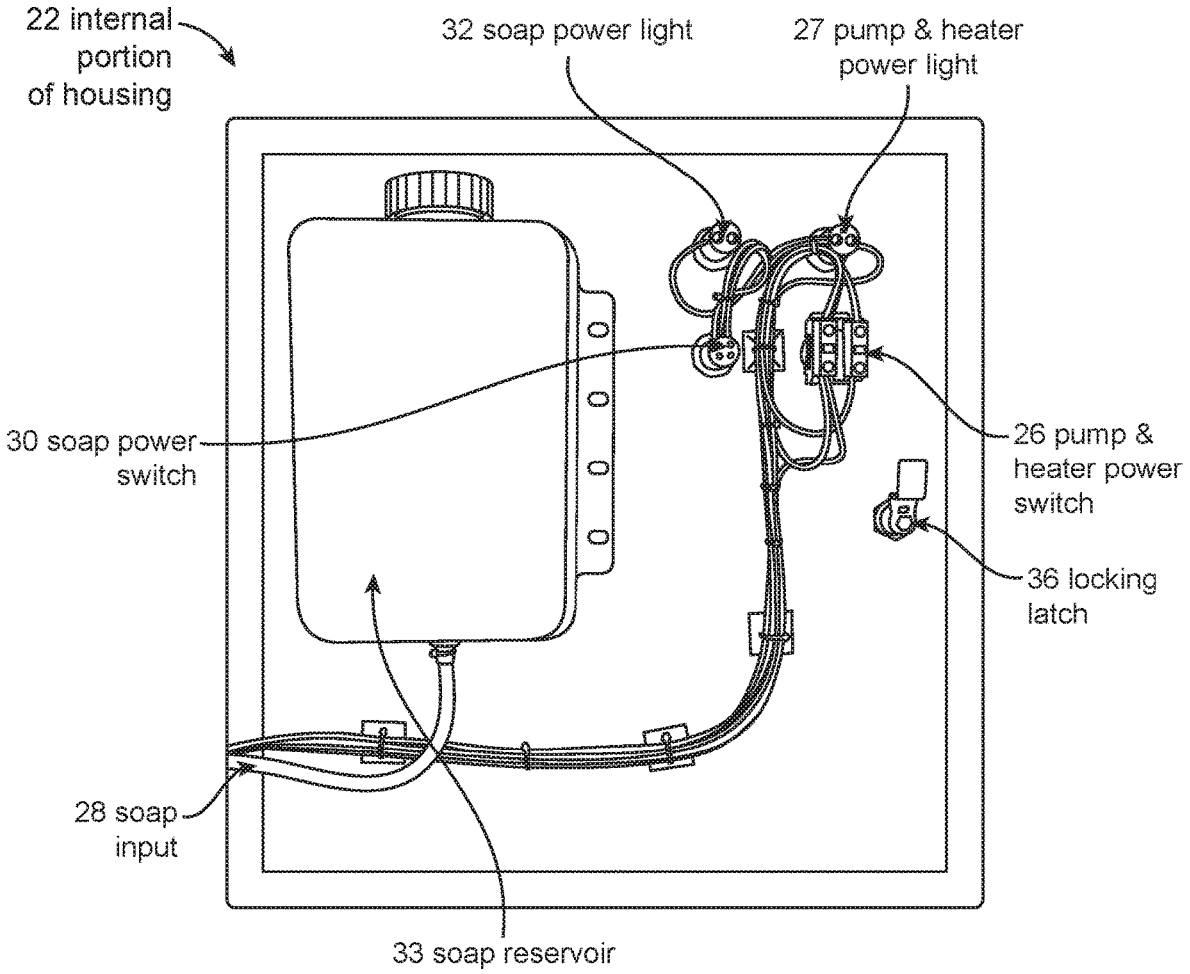
FIGS. 4, 5, and 6 illustrate an internal portion of a housing of a watercraft cleaning system, according to some embodiments.

As further shown in FIG. 1, the system may also include a soap and wax input 28 fluidly coupled to the water line 16. The soap and wax input 28 may comprise any variety of liquids and substances for cleaning watercraft, such as soap, wax, cleaning agents, and the like. As shown in FIG. 4, the soap, wax, and any other cleaning agents may be stored in a soap reservoir 33 fluidly coupled to the soap and wax input 28. The soap reservoir 33 may be located along the internal portion of the housing 12 whereby the reservoir 33 can be easily refilled by a user.

As illustrated in FIGS. 1 and 4, the system may thereby include a soap and wax power switch 30 mechanically coupled to the housing 12 and operatively coupled to the soap and wax input 28. The soap and wax power switch 30 may thereby allow a user to include or exclude soap and wax from the high-pressure output line 22 during cleaning of the watercraft. In other words, during operation, when the soap and wax power switch 30 is pressed (or turned on) this causes a soap and wax solenoid valve 44 to open. Accordingly, when the soap and wax power switch 30 is pressed again (or turned off) this causes the soap and wax solenoid valve 44 to close.

Systems may also include various components to indicate the operational status of the system. For example, as previously mentioned, the system may include a power light 27, such as a pump and heater power light, electrically and communicatively coupled to the power button 26. In this regard, when the power button 26 is pulled and the system is powered on, the pump and heater power light 27 illuminates to indicate that the respective components have been powered on. In many embodiments, as shown in the figures, the power light 27 is coupled to the cover 34. However, in some embodiments, the power light 27 may be coupled to any surface of the housing 12. The pump and heater power light 27 may define any color or type of light. For example, the pump and heater power light 27 may comprise a green light emitting diode (LED).

Furthermore, in some embodiments, the system 10 includes a soap and wax indication light 32 mechanically coupled to the housing 12 and electrically coupled to the soap and wax power switch 30. The soap and wax indication light 32 may be arranged and configured to provide an indication as to whether soap and wax is included in the high-pressure output line 22. For example, when the indication light 32 is illuminated this may indicate that soap and wax is present in the high-pressure output line 22. The soap and was indication light 32 may define any color or type of light. In some embodiments, the soap and wax indication light 32 comprises a green LED.

In order to access components located along the internal portion 20 of the housing 12, a front portion of the housing 12 may include a cover 34 that hingedly moves with respect to the housing 12. It should be appreciated that the cover 34 may be hingedly coupled to the housing 12 via at least one hinge 35. Furthermore, it should also be appreciated that the cover 34 may couple to the housing 12 via any variety, such as rotatably, frictionally, magnetically, and the like.

In some embodiments, the power button 26, the soap and wax power switch 30, and the soap and wax indication light 32 are located on the cover 34. Even still, in some embodiments, the power button 26, the soap and wax power switch 30, and the soap and wax indication light 32 are located closer to a top edge of the housing 12 than a bottom edge of the housing 12 and located along a same side of the locking latch 36. In other words, when looking at FIG. 1, the power button 26, the soap and wax power switch 30, and the soap and wax indication light 32 may be located in the upper left corner of the cover 34.

As further shown in FIGS. 1-4, the system 10 may include a locking latch 36, also referred to as a handle and key system 36, mechanically and operatively coupled to the cover 34. The handle and key system 36 may thereby allow the user to lock the cover 34 to keep the internal contents safe, and of course, unlock the cover 34 to allow the cover to move with respect to the housing 12 and thereby allow access to the internal portion 20 of the housing 12.

Figure 2:
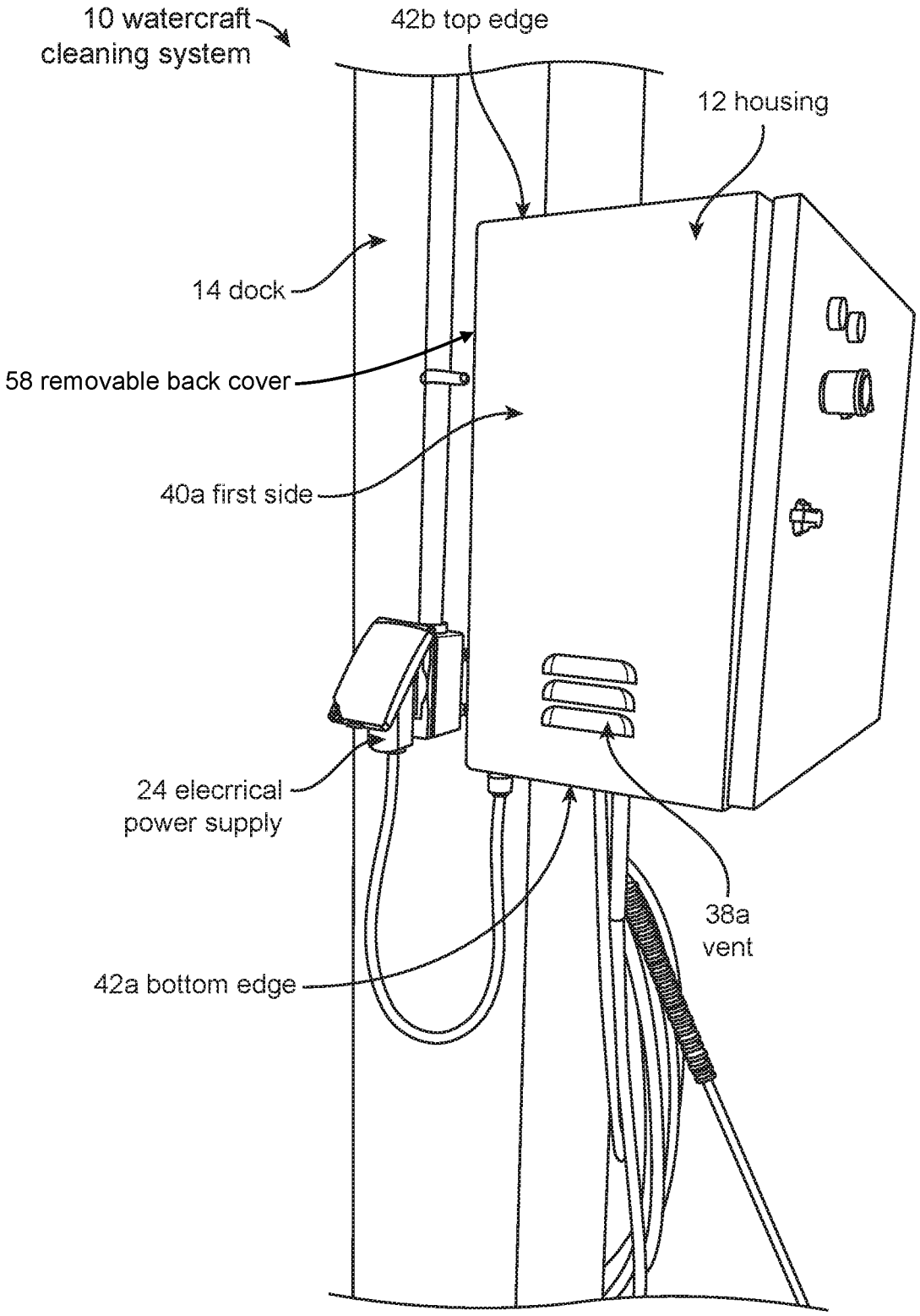
FIG. 2 illustrates a first side perspective view of a watercraft cleaning system, according to some embodiments.
Figure 3:
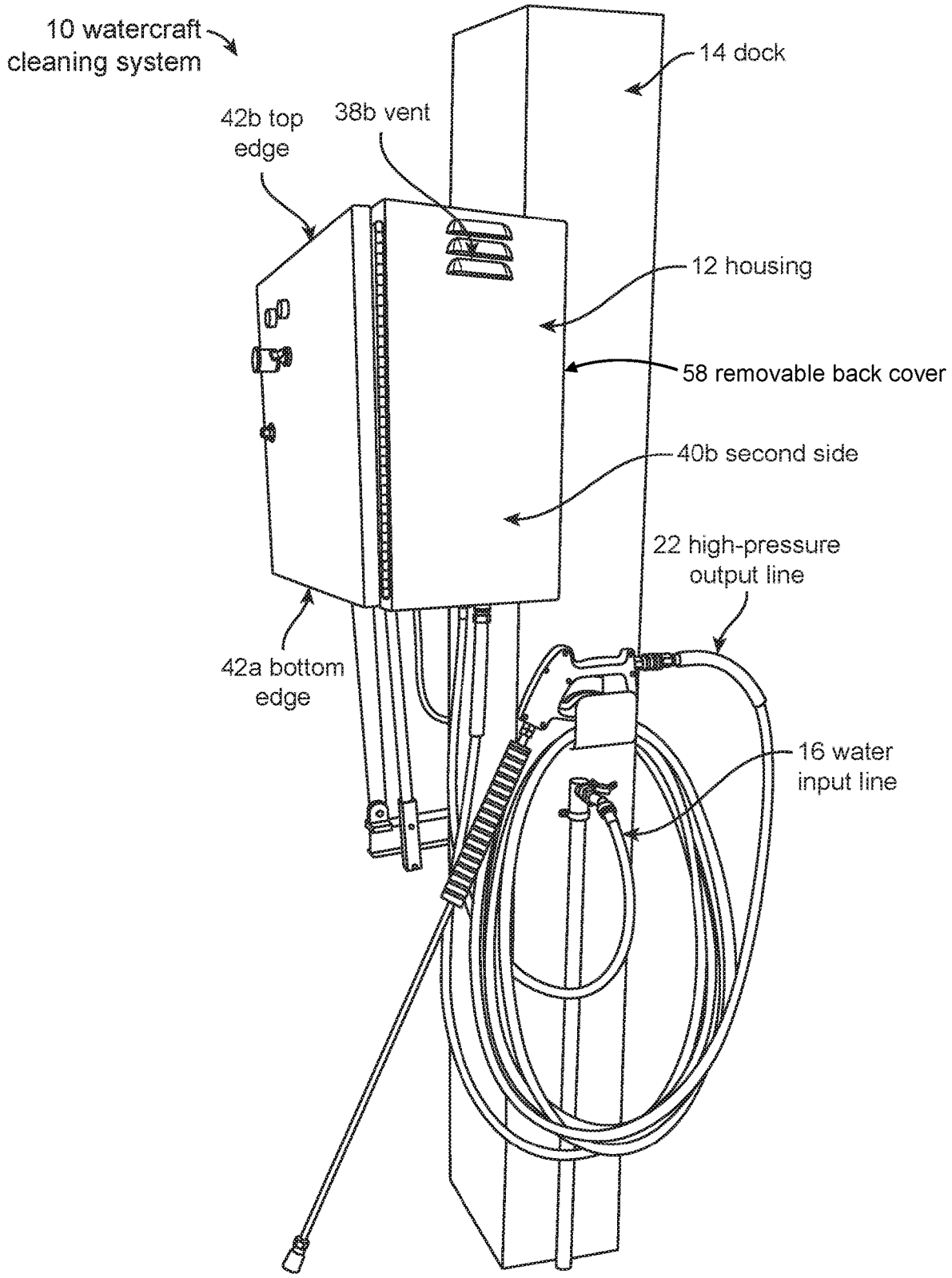
FIG. 3 illustrates a second side perspective view of a watercraft cleaning system, according to some embodiments.

In order to provide ventilation to the internal portion 20 of the housing 12, the system 10 may include one or more vents 38. As shown in FIG. 2, the system 10 may include a first vent 38*a* coupled to the housing 12 and located along a first side 40*a* of the housing 12. The first vent 38*a* may be located closer to a bottom edge 42*a* of the housing 12 than a top edge 42*b* of the housing 12. With reference to FIG. 3, the system 10 may include a second vent 38*b* coupled to the housing 12 and located along a second side 40*b* of the housing 12. It should be appreciated that the second side 40*b* may be located opposite the first side 40*a*. In some embodiments, the second vent 38*b* is located closer to the top edge 42*a* of the housing 12 than the bottom edge 42*b* of the housing 12.

Also, embodiments may include a heater 39 mechanically coupled to an internal portion of the housing 12. The heater 39 may be arranged and configured to heat the internal portion 22 of the housing 12 to thereby keep the internal portion 22 dry during large temperature swings.

Figure 5:
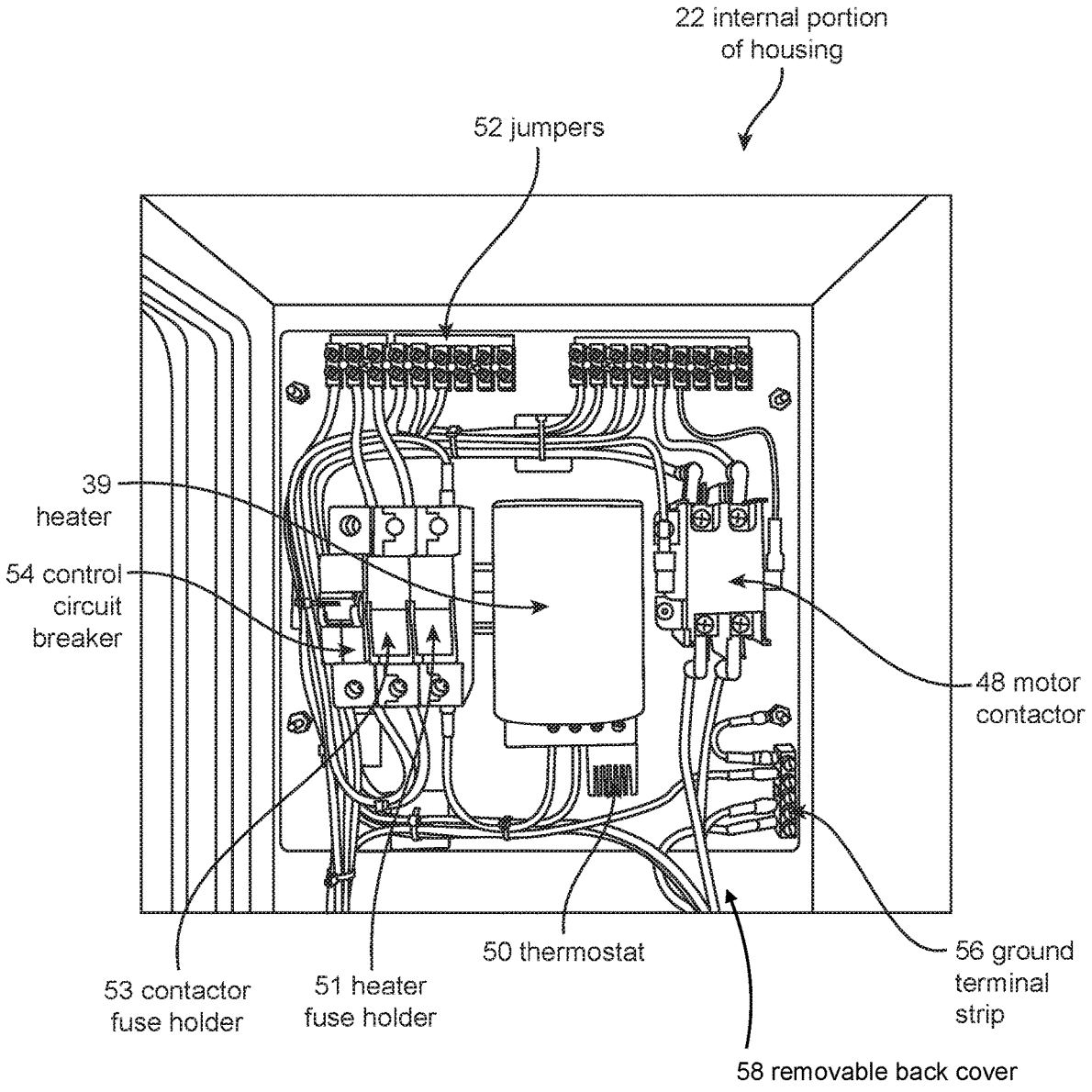
Figure 6:
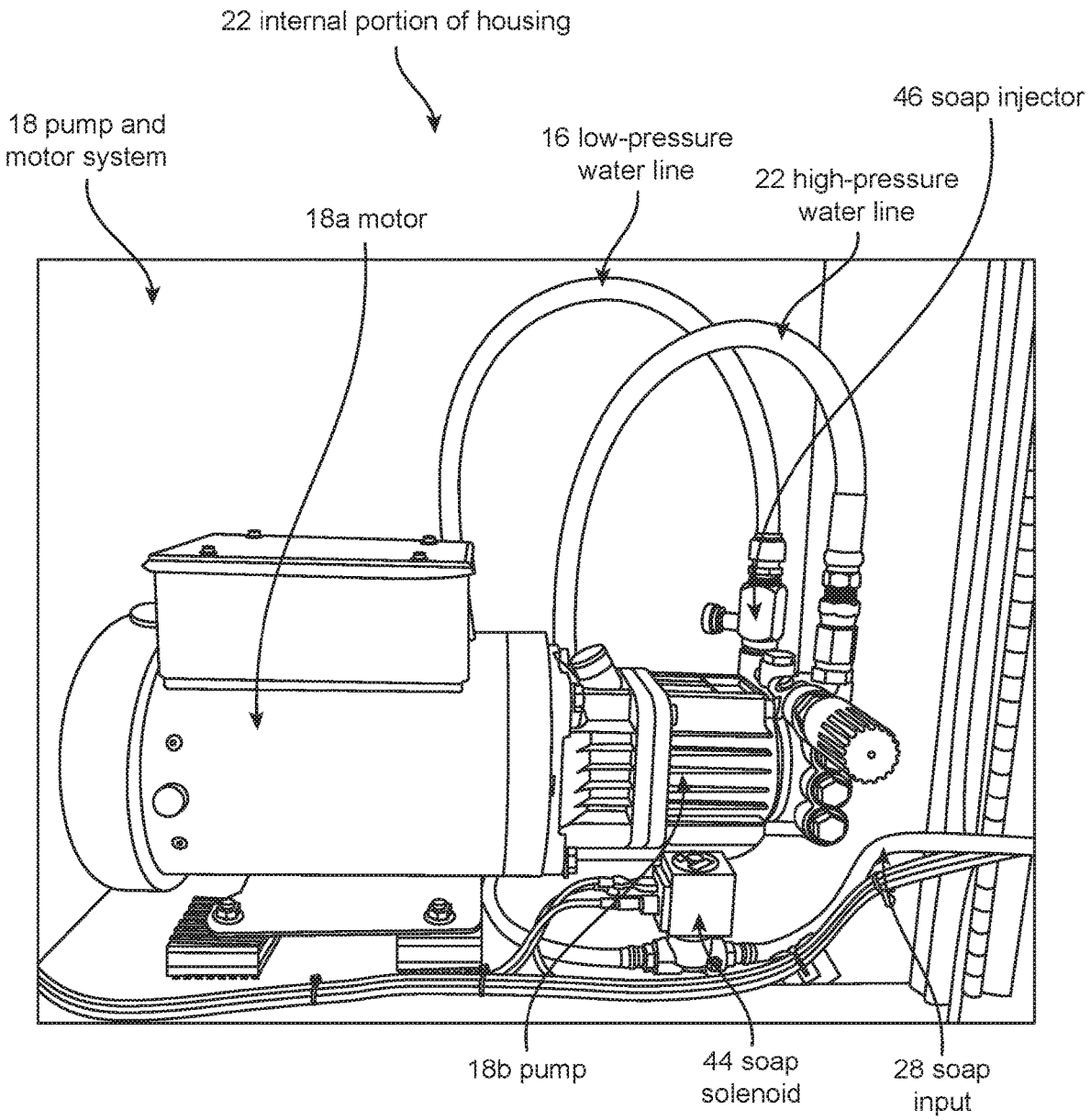

Now with reference to FIG. 5, the system may include a variety of electrical components to ensure proper electrical coupling and safe operation of the system. According to FIG. 5, the system may include a thermostat 50, which may monitor and/or control the heat produced by the heater 39. Additionally, the system may include a plurality of jumpers 52 to properly route and couple the various electrical connections between components. In order to ensure safe operation, the system may include a control circuit breaker 54 and ground terminal strip 56 to protect against electrical overloads. During operation, when the power button 26 is in the off position (i.e. motor not running) this causes power to be directed to the thermostat 50. Accordingly, when the temperature falls to a predetermined temperature (e.g. 59 degrees Fahrenheit) it will cause the heater 39 to activate and heat the internal portion of the housing 12.

The system 10 may include a soap injector 46 coupled to the internal portion 20 of the housing 12. The soap injector 46 may be arranged and configured to control an amount of soap and wax delivered to the water line 16. In this regard, the user may have variable control over how much or how little soap and wax to dispense into the input (or supply) side of the system 10. In some embodiments, the soap injector 46 is located adjacent to the pump and motor system 18.

Additionally, as previously mentioned, the system 10 may include a motor contactor 48 electrically coupled to the electrical power supply 24 and electrically coupled to the pump and motor system 18. The motor contactor 48 may be arranged and configured to control electrical power to the pump and motor system 18. Furthermore, the motor contactor 48 may be further arranged and configured to protect the pump and motor system 18 from electrical overloads. In operation, when the motor contactor 48 is energized in response to the power button 26 being pulled out, the motor contactor 48 closes its contacts and thereby sends power to the pump and motor system 18 to activate. As well, the system 10 may include a heater fuse holder 51 that is electrically and communicatively coupled to the heater 39 and thermostat 50. The heater fuse holder 51 may comprise a slow acting fuse whereby the heater fuse holder 51 sends power to the thermostat 50, which controls the heater 39. Even still, the system 10 may include a contactor fuse holder 53 that is electrically and communicatively coupled to the motor contactor 48 and/or the motor and pump system 18.

The contactor fuse holder 53 may comprise a fast acting fuse whereby the contactor fuse holder 53 sends power to the line side of the motor contactor.

In many embodiments, the housing 12 is fully enclosed. However, the housing 12 may be partially enclosed. Specifically, in some embodiments, a back portion of the housing 12, such as the back cover 58, may be removable to expose the internal portion 22 of the housing 12 and thereby provide easier access to the components of the system 10. Additionally, in some embodiments, any other portion of the housing, such as the first side, second side, top, and/or bottom may be removable. In this regard, in some embodiments, the housing 12 is a frame with removable sides. The housing 12 may also refer to the entire enclosure that surrounds the internal portion 22 of the housing 12 and the components.

Interpretation

None of the steps described herein is essential or indispensable. Any of the steps can be adjusted or modified. Other or additional steps can be used. Any portion of any of the steps, processes, structures, and/or devices disclosed or illustrated in one embodiment, flowchart, or example in this specification can be combined or used with or instead of any other portion of any of the steps, processes, structures, and/or devices disclosed or illustrated in a different embodiment, flowchart, or example. The embodiments and examples provided herein are not intended to be discrete and separate from each other.

The section headings and subheadings provided herein are nonlimiting. The section headings and subheadings do not represent or limit the full scope of the embodiments described in the sections to which the headings and subheadings pertain. For example, a section titled "Topic 1" may include embodiments that do not pertain to Topic 1 and embodiments described in other sections may apply to and be combined with embodiments described within the "Topic 1" section.

Some of the devices, systems, embodiments, and processes use computers. Each of the routines, processes, methods, and algorithms described in the preceding sections may be embodied in, and fully or partially automated by, code modules executed by one or more computers, computer processors, or machines configured to execute computer instructions. The code modules may be stored on any type of non-transitory computer-readable storage medium or tangible computer storage device, such as hard drives, solid state memory, flash memory, optical disc, and/or the like. The processes and algorithms may be implemented partially or wholly in application-specific circuitry. The results of the disclosed processes and process steps may be stored, persistently or otherwise, in any type of non-transitory computer storage such as, e.g., volatile or non-volatile storage.

The various features and processes described above may be used independently of one another, or may be combined in various ways. All possible combinations and subcombinations are intended to fall within the scope of this disclosure. In addition, certain method, event, state, or process blocks may be omitted in some implementations. The methods, steps, and processes described herein are also not limited to any particular sequence, and the blocks, steps, or states relating thereto can be performed in other sequences that are appropriate. For example, described tasks or events may be performed in an order other than the order specifically disclosed. Multiple steps may be combined in a single block or state. The example tasks or events may be performed in serial, in parallel, or in some other manner. Tasks or events may be added to or removed from the disclosed example embodiments. The example systems and components described herein may be configured differently than described. For example, elements may be added to, removed from, or rearranged compared to the disclosed example embodiments.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

The term "and/or" means that "and" applies to some embodiments and "or" applies to some embodiments. Thus, A, B, and/or C can be replaced with A, B, and C written in one sentence and A, B, or C written in another sentence. A, B, and/or C means that some embodiments can include A and B, some embodiments can include A and C, some embodiments can include B and C, some embodiments can only include A, some embodiments can include only B, some embodiments can include only C, and some embodiments include A, B, and C. The term "and/or" is used to avoid unnecessary redundancy.

While certain example embodiments have been described, these embodiments have been presented by way of example only, and are not intended to limit the scope of the inventions disclosed herein. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the inventions disclosed herein.

The following is claimed:

1. A watercraft cleaning system, comprising:

a housing coupled to a dock post;

a water input line mechanically coupled to the housing;

a pump and motor system mechanically coupled to an internal portion of the housing and operatively coupled to the water input line, the pump and motor system arranged and configured to increase pressure of water from the water input line;

a high-pressure output line mechanically coupled to the housing and fluidly coupled to the water input line;

a heater mechanically coupled to the internal portion of the housing, the heater arranged and configured to heat the internal portion of the housing;

a door hingedly coupled to the housing, the door configured to move between a locked position and an open position; and a soap reservoir fluidly coupled to the water input line and mechanically coupled to the door.

2. The system of claim 1, further comprising an electrical power supply electrically coupled to the pump and motor system.

3. The system of claim 2, wherein electrical power from the electrical power supply is transmitted to the pump and motor system via a ground fault circuit interrupter plug mechanically coupled to the housing.

4. The system of claim 2, further comprising a power button mechanically coupled to the housing and electrically coupled to the pump and motor system and the heater, the power button arranged and configured to power on the pump and motor system and the heater.

5. The system of claim 4, further comprising a soap power switch mechanically coupled to the housing and operatively coupled to the soap reservoir to thereby allow a user to include and exclude soap.

6. The system of claim 5, further comprising a soap indication light mechanically coupled to the housing and electrically coupled to the soap power switch to thereby provide an indication as to whether soap is being outputted.

7. The system of claim 6, further comprising a locking latch mechanically and operatively coupled to the door whereby the locking latch allows the user to move the door between a locked position and an open position with respect to the housing.

8. The system of claim 7, wherein the power button, the soap power switch, and the soap indication light are located on the door.

9. The system of claim 8, wherein the power button, the soap power switch, and the soap indication light are located closer to a top edge of the housing than a bottom edge of the housing and located along a same side of the locking latch.

10. The system of claim 9, further comprising a first vent coupled to the housing and located along a first side of the housing.

11. The system of claim 10, wherein the first vent is located closer to a bottom edge of the housing than a top edge of the housing.

12. The system of claim 10, further comprising a second vent coupled to the housing and located along a second side of the housing, the second side located opposite the first side, wherein the second vent is located closer to the top edge of the housing than the bottom edge of the housing.

13. The system of claim 12, further comprising a soap solenoid valve coupled to the internal portion of the housing, the soap solenoid valve arranged and configured to control whether soap is outputted.

14. The system of claim 13, wherein the soap solenoid valve is located adjacent to the pump and motor system.

15. The system of claim 13, further comprising a motor contactor electrically coupled to the electrical power supply and electrically coupled to the pump and motor system, the motor contactor arranged and configured to control electrical power to the pump and motor system, the motor contactor further arranged and configured to protect the pump and motor system from electrical overloads, wherein the housing is constructed of at least one of stainless steel and aluminum.

16. The system of claim 1, further comprising a thermostat operatively coupled to the heater.

17. The system of claim 16, wherein the thermostat is arranged and configured to activate the heater when a temperature within the internal portion of the housing reaches a predetermined temperature, and wherein the system is arranged and configured such that when the pump and motor system is activated, the heater is deactivated.

* * * * *